United States Patent [19]

Shibata

[11] Patent Number: 4,781,087

[45] Date of Patent: Nov. 1, 1988

[54] APPARATUS AND METHOD FOR CUTTING TOWEL CLOTH

[75] Inventor: Yoshio Shibata, Aichi, Japan

[73] Assignee: Kabushikikiaisha Barudan, Aichi, Japan

[21] Appl. No.: 38,264

[22] Filed: Apr. 14, 1987

[30] Foreign Application Priority Data

Apr. 18, 1986 [JP] Japan ..... 61-89534

[51] Int. Cl.[4] ..... D06H 7/02

[52] U.S. Cl. ..... 83/18; 83/42; 83/208; 83/210; 83/215; 83/368; 83/371

[58] Field of Search ..... 83/13, 18, 42, 56, 175, 83/208, 210, 215, 262, 264, 265, 368, 371, 372, 386, 636, 363, 71

[56] References Cited

U.S. PATENT DOCUMENTS

| | | | |
|---|---|---|---|
| 3,182,536 | 5/1965 | Sumpter, Jr. et al. | 83/175 |
| 3,192,811 | 7/1965 | Simmons et al. | 83/175 |
| 4,034,634 | 7/1977 | Arbter | 83/175 |
| 4,375,175 | 3/1983 | Elsas et al. | 83/175 |
| 4,437,369 | 3/1984 | Brocklehurst et al. | 83/18 |
| 4,586,411 | 5/1986 | Koivula | 83/18 |
| 4,601,225 | 7/1986 | Starnes et al. | 83/175 |

FOREIGN PATENT DOCUMENTS 60-75667 4/1985 Japan .

*Primary Examiner*—Donald R. Schran
*Assistant Examiner*—Hien H. Phan
*Attorney, Agent, or Firm*—Pollock, Vande Sande & Priddy

[57] ABSTRACT

A positioning device is disposed along a conveyor path of long towel cloth pulled out by a pull-out device. The positioning device stops the movement of the towel cloth while locking the boundary between a flat fabric section and a subsequent piled fabric section of the towel cloth. A cutting device is disposed downstream relative to the positioning device in the direction of movement of the towel cloth, and a size measuring device is disposed on the opposite upstream side. The positioning device and the cutting device are relatively movable to be spaced from and approached by each other. When the towel cloth is pulled out by the pull-out device, the length of the flat fabric section of the towel cloth is measured by the size measuring device. Based on the measured value, the spacing between the positioning device and the cutting device is adjusted to be equal to a half of the measured value. Thereafter, when the towel cloth is stopped by the positioning device, the cutting device is operated to cut the towel cloth.

3 Claims, 8 Drawing Sheets

APPARATUS AND METHOD FOR CUTTING TOWEL CLOTH

BACKGROUND OF THE INVENTION

1. Field of the Invention

This invention relates to an apparatus for cutting long towel cloth formed of piled fabric sections and flat fabric sections woven alternately, and more particularly to an apparatus for cutting long towel cloth at intermediate positions of the individual flat fabric sections.

Such cutting of towel cloth creates a number of towel blanks, each comprising a piled fabric section which has at both ends a pair of flat fabric sections to be formed into folded hems. The flat fabric sections at both ends of each towel blank are then folded and sewn. As a result, the towel blanks come into final towel products.

2. Description of the Prior Art

The above-mentioned cutting of towel cloth was manually performed in the past and had low efficiency.

The present inventor has, therefore, devised and put into practice an apparatus as described hereinbelow. The apparatus comprises a pull-out device for pulling out towel cloth; a positioning device disposed along a conveyor path of the towel cloth pulled out by the pull-out device and adapted to, when the boundary of a flat fabric section and a subsequent piled fabric section of the towel cloth has arrived, stop the movement of the towel cloth while locking a leading end of the piled fabric section; and a cutting device disposed along the conveyor path downstream relative to the positioning device in the direction of movement of the towel cloth and adapted to cut the towel cloth being positioned by the positioning device. The spacing between the positioning device and the cutting device is set equal to a half of the prearranged length of the flat fabric section.

By using such apparatus, the long towel cloth can be cut at the individual flat fabric sections successively in a more efficient manner.

However, the long towel cloth sometimes has many flat fabric sections which are different from one another longitudinally. Specifically, the individual flat fabric sections are woven into substantially equal sizes in the process of fabricating long towel cloth. The fabricated towel cloth is then sequentially passed through a bleaching step, a dying step, a drying step, etc. The tension exerted on the long towel cloth is not always constant throughout those steps. As a result, some of the flat fabric sections are shrunk into smaller lengths, while others thereof are extended into larger lengths. Cutting such towel cloth by the cutting device gives rise to disadvantages.

More specifically, in case of cutting the flat fabric section shorter than a prearranged size, the succeeding towel blank with respect to the cut position is cut to have a flat fabric section of predetermined length on the leading end side thereof. However, the preceding towel blank with respect to the cut position is cut to have a flat fabric section on the trailing end side thereof which is extremely shorter than a predetermined size. Such extremely short flat fabric section cannot be formed with a folded hem in the later step. Thus, those towel blanks must be rejected as defective goods.

On the other hand, in case of cutting the flat fabric section longer than a prearranged size, the succeeding towel blank with respect to the cut position is cut to have a flat fabric section of predetermined length on the leading end side thereof. However, the preceding towel blank with respect to the cut position is cut to have a flat fabric section on the trailing end side thereof which is extremely longer than a predetermined size. If a folded hem is formed in such extremely long flat fabric section, there would still remain a lengthy flat fabric section between the folded hem thus, and the adjacent piled fabric section, making the appearance of the towel very poor. Thus, those towel blanks must also be treated as defective goods. Therefore, there is a higher occurrence of defective goods.

SUMMARY OF THE INVENTION

It is, therefore, one object of the present invention to provide an apparatus capable of successively cutting long towel cloth at intermediate positions of flat fabric sections with improved efficiency as is in the conventional apparatus.

Another object of the present invention is to provide apparatus capable of cutting individual flat fabric sections at just middle positions thereof even with variations in longitudinal sizes of the flat fabric sections, when cutting towel cloth at individual flat fabric sections thereof.

According to the apparatus of the present invention which is capable of cutting the flat fabric sections at just middle positions thereof, in case of cutting the flat fabric section shorter than a prearranged size, the lack of the size can be shared by the flat fabric section on the leading end side of the succeeding towel blank with respect to the cut position and the flat fabric section on the trailing end side of the preceding towel blank with respect to the cut position. Accordingly, both the flat fabric sections become shorter than a predetermined size evenly by a slight amount. Stated otherwise, there is no chance of either one flat fabric section being cut to be extremely short as was experienced in the conventional apparatus. The flat fabric section slightly shorter than a prearranged size is adaptable for the formation of a folded hem by such a simple correction as reducing the size of the folded hem to some extent. Thus, the succeeding towel blank and the preceding towel blank can be both treated as good products.

On the other hand, in case of cutting the flat fabric section larger than a prearranged size, the excess of the size can be shared by the flat fabric section on the leading end side of the succeeding towel blank with respect to the cut position and the flat fabric section on the trailing end side of the preceding towel blank with respect to the cut position. Accordingly, both the flat fabric sections become longer than a predetermined size evenly by a slight amount. Stated otherwise, there is no chance of either one flat fabric section being cut to be extremely long as was experienced in the conventional apparatus. The flat fabric section slightly longer than a prearranged size is adaptable for the formation of a folded hem by such a simple correction as increasing the size of the folded hem to some extent. Thus, the succeeding towel blank and the preceding towel blank can be both treated as good products.

As described above, the apparatus of the present invention can offer an advantage of reducing the occurrence rate of defective goods.

Other objects and advantages of the invention will become apparent during the following discussion of the accompanying drawings.

DESCRIPTION OF THE PREFERRED EMBODIMENTS

Figure 1:
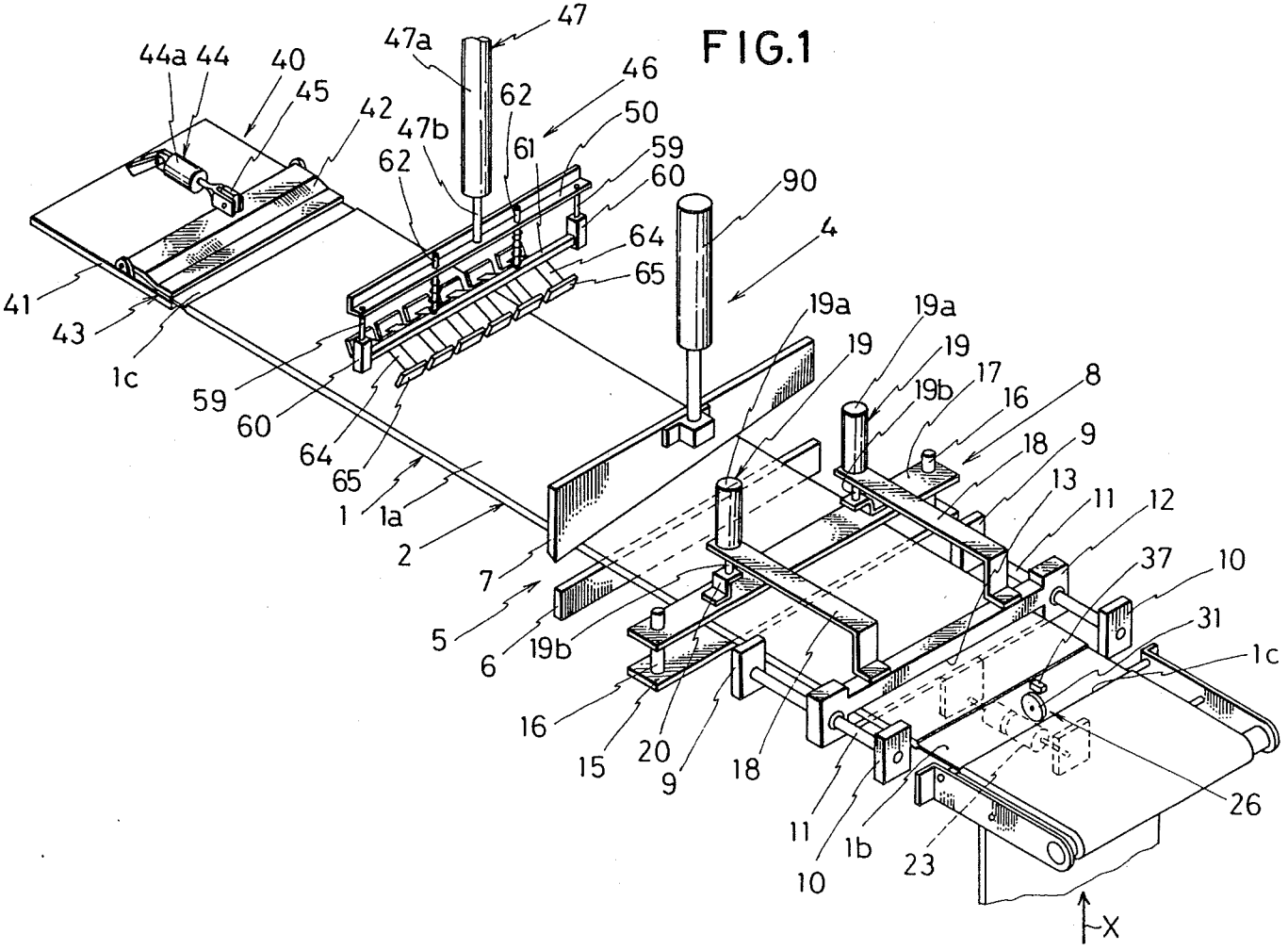
FIG. 1 is a perspective view showing the entire towel cutting apparatus.
Figure 2:
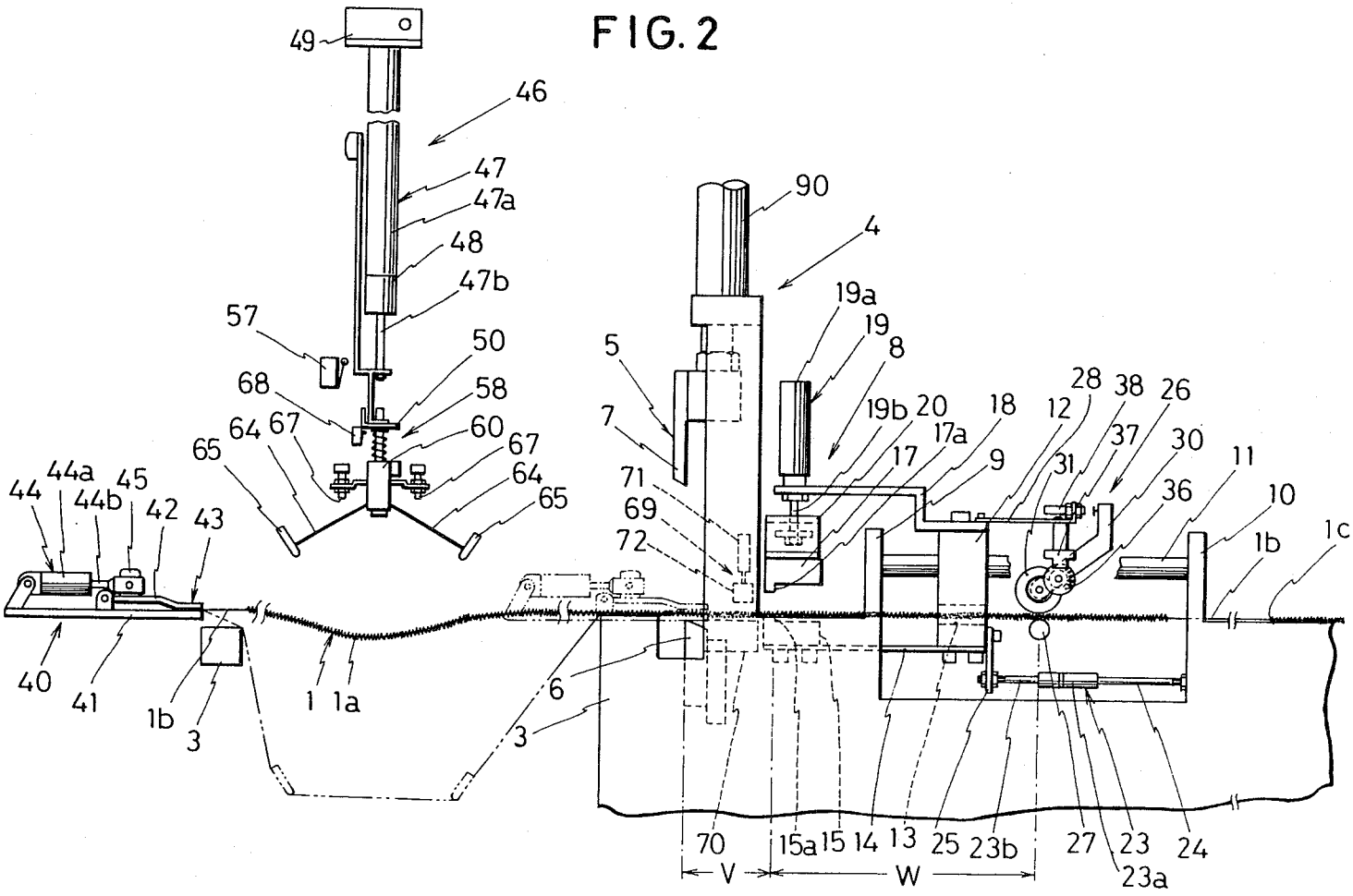
FIG. 2 is a side view showing substantially the entire towel cutting apparatus.

Referring to FIGS. 1 and 2, long towel cloth 1 has piled fabric sections 1*a* and flat fabric sections 1*b* lying alternately. As seen from FIG. 6, the piled fabric section 1*a* has a thickness larger than that of the flat fabric section 1*b*. The towel cloth 1 is generally wound round a roll and supplied to a towel cutting apparatus from the side indicated by an arrow X in FIG. 1. The towel cloth 1 is transferred along a prescribed conveyor path 2 over a frame 3 of the towel cutting apparatus.

The towel cutting apparatus comprises a towel cloth pull-out device 40, a towel cloth positioning device 8, a towel cloth cutting device 4, a towel cloth correction device 46, a size measuring device 26 for the flat fabric section, and an adjusting device 23 for adjusting a relative distance between the positioning device 8 and the cutting device 4. These devices are mounted on the frame 3 in FIG. 2.

The positioning device 8 is adapted to, when the boundary 1*c* of the flat fabric section 1*b* and the subsequent piled fabric section 1*a* of the towel cloth 1 has arrived, stop the movement of the towel cloth 1 while locking a leading end of the piled fabric section 1*a*.

The cutting device 4 is adapted to cut the towel cloth 1 being positioned by the positioning device 8.

Respective component members of the cutting device 4 and the positioning device 8 are designated at reference numerals 5 to 7 and 9 to 22.

More specifically, the cutting device 4 includes a cutter 5 which consists of a fixed blade 6 and a movable blade 7 capable of moving up and down by a cutting cylinder 90. The positioning device 8 includes a pair of guide rods 11 fixedly supported by corresponding supports 9, 10. Designated at 12 is a support member fitted on the guide rods 11 to be movable in the lengthwise direction of the conveyor path 2. The support member 12 has formed in the portion corresponding to the conveyor path 2 a cut-out window 13 through which the towel cloth 1 is passed. A pair of support arms 14 are attached to the under side of the support member 12. Designated at 15 is a lower positioner fixed to the support arms 14. A pair of guide pins 16 are attached to the lower positioner 15, and an upper positioner 17 is mounted on the guide pins 16 to be movable up and down. Respective stopper parts 15*a*, 17*a* of the positioners 15, 17 are adapted to allow passage of the flat fabric section 1*b* therethrough in a state where the flat fabric section 1*b* of the long towel cloth 1 is coming between the stopping parts, but when the boundary 1*c* between the flat fabric section 1*b* and the subsequent piled fabric section 1*a* has arrived, to block passage of the piled fabric section 1*a* while locking a leading end of the piled fabric section 1*a*. Each of the stopper parts 15*a*, 17*a* has a width size larger than that of the towel cloth. The spacing V between the cutter 5 and the stopper part 15*a* is set equal to approximately a half (e.g., 35 mm) of a length (e.g., 70 mm) of the flat fabric section 1*b* of the long towel cloth 1. Designated at 18 is a support arm attached to the upper side of the support member 12, and 19 is a cylinder for lifting the upper positioner 17. A cylinder body 19*a* of the cylinder 19 is fixed to the support arm 18 and, as detailed in FIG. 6, a piston rod 19*b* thereof is inserted through a through hole 20*a* in a suspension member 20 fixed to the positioner 17. Designated at 21 is a slip-off prevention nut and 22 is a slip-off prevention washer.

The pull-out device 40 has a base plate 41 which is movable reciprocally between a pull-out position indicated by solid lines and a gripping position indicated by imaginary lines in FIG. 2. The reciprocal movement of the base plate 41 is achieved by a fluid cylinder, for example. A gripping plate 42 is pivotally connected to the base plate 41 in an openable manner. The leading end portion of the gripping plate 42 constitutes, together with the leading end portion of the base plate 41, a gripper 43 for gripping the flat fabric section 1*b*. The gripper 43 is opened and closed by an open/close cylinder 44. A body 44*a* of the cylinder 44 is coupled to the base plate 41, and a piston rod 44*b* thereof is coupled to a projection 45 upwardly projecting from the gripping plate 42.

Figure 9:
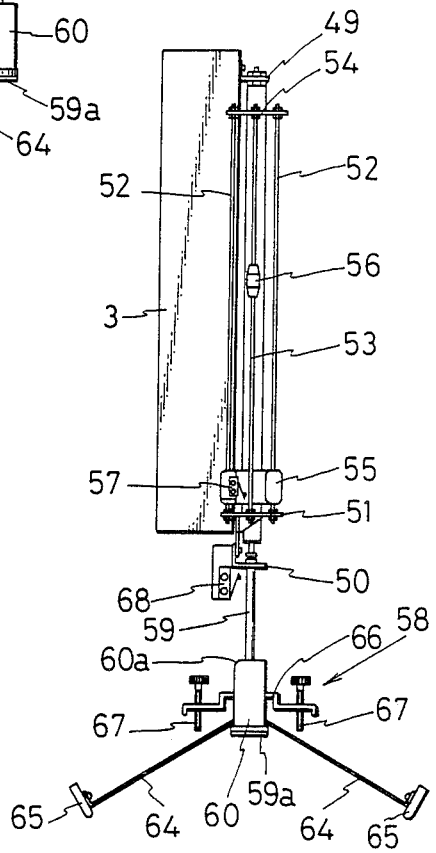
FIG. 9 is a view as looked at in the direction of an arrow IX in FIG. 8.
Figure 11:
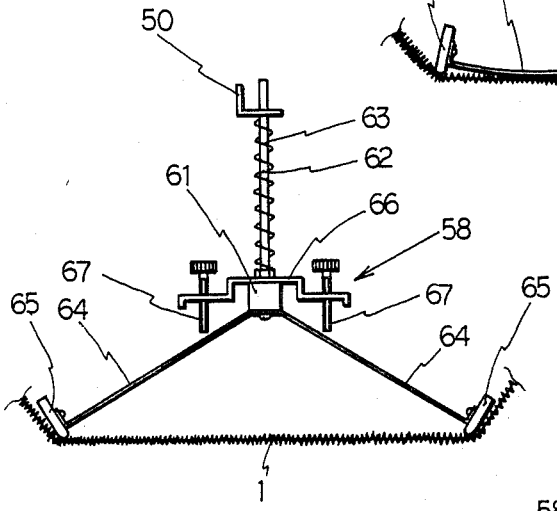
FIGS. 11 and 12 are explanatory views showing respective operated states of the correction device.
Figure 12:
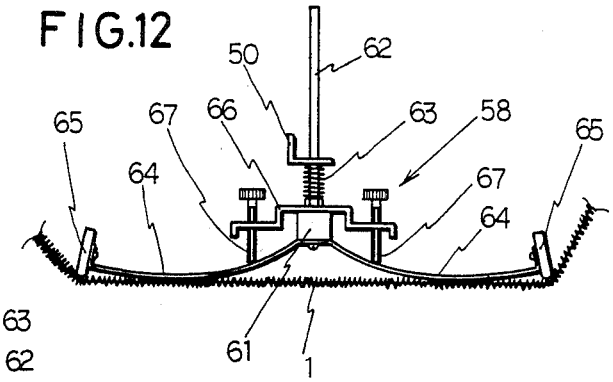

The correction device 46 is adapted to bring the boundary 1*c* between the flat fabric section 1*b* and the piled fabric section 1*a* of the towel 1, into engagement with the positioners 15, 17 throughout the width of the towel cloth 1. To this end, the correction device 46 is constituted, as shown in FIGS. 1, 2 and 8 to 14, so that the long towel cloth 1 lying between the pull-out device 40 and the positioning device 8 is elastically pushed down throughout the width thereof. Specifically, a correction cylinder 47 of the correction device 46 comprises a body 47*a* attached to the frame 3 by a fitting 49, and a piston rod 47*b* capable of extending and retreating with respect to the body 47*a*. The cylinder 47 is provided at the lower end portion thereof with a brake 48 for applying a braking force to the piston rod 47*b*. Fixed to the lower end of the piston rod 47*b* is a support frame 50. A pair of guide rods 52 and a single detection rod 53 are secured at their respective lower ends to a support plate 51 in turn fixed to the support frame 50. The respective upper ends of the guide rods 52 and the detection rod 53 are interconnected through a connection plate 54. The guide rods 52 are retained to be movable up and down by a retainer 55 fixed to the frame 3. A dog 56 is secured to the intermediate portion of the detection rod 53. The dog 56 serves to actuate a deceleration switch 57 secured to the retainer 55. The support frame 50 is provided with a correction mechanism 58. In this correction mechanism 58, a pair of guide rods 59 are fixed to the support frame 50 at the opposite ends thereof. The guide rods 59 may be formed of a bolt. A sleeve 60 is fitted on each of the guide rods 59 to be movable up and down with a head of the bolt serving to prevent it from slipping off. Fixed to the sleeves 60, 60 is a movable frame 61 at the opposite ends thereof which assumes a substantially horizontal attitude. A pair of support rods 62 are erected on the upper side of the movable frame 61, and the upper end of each support rod 62 is inserted through a corresponding through hole 50*a* in the support frame 50. Fitted around the spring support rod 62 is a compression spring 63 for urging the movable frame 61 downwardly. Plural pairs of front and rear leaf springs 64 are secured to the movable frame 61. In this embodiment, each pair of front and rear leaf springs 64 are constituted by a single member and, as shown in FIG. 9, have their lower end portions projecting downwardly at an angle in a natural state thereof. As will be seen from FIG. 13, the paired leaf springs 64, 64 are arranged in plural number throughout the width of conveyor path of the towel cloth 1 with equal intervals therebetween. Fixed to the distal end of each leaf spring 64 is a pusher 65 for pushing the towel cloth from above. Also, secured to the upper side of the movable frame 61 is a plurality of stopper plates 66. As best seen from FIG. 12, the stopper plates 66 are each provided with a pair of stops 67 which are adapted to stop the upper sides of the leaf springs 64, when the leaf springs 64 are flexed upwardly, to thereby increase resilient forces of the leaf springs 64. For adjustment of the degree of a resilient force of the leaf spring 64, the stop 67 is constituted by a bolt screwed into the stopper plate 66. Attached to the support frame 50 is, as shown in FIG. 9, a correction confirmation switch 68. When the support frame 50 is lowered, causing the movable frame 61 to relatively move toward the support frame 50, as shown in FIG. 12, the switch 68 is actuated by a dog part 60*a* formed on the sleeve 60.

Figure 3:
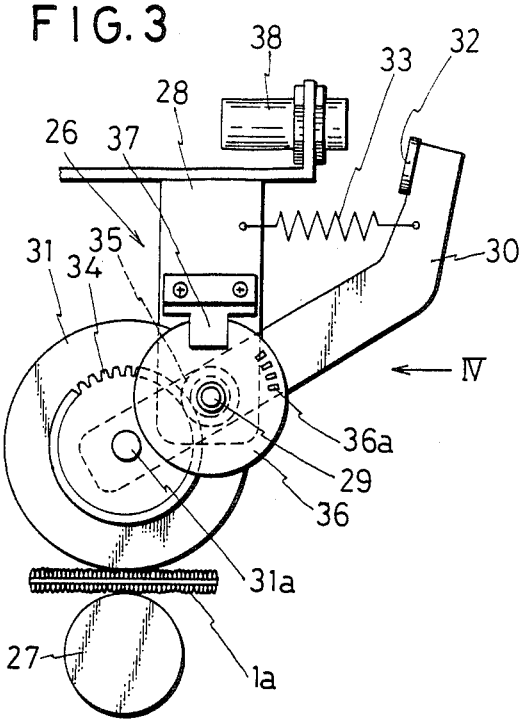
FIG. 3 is a side view of a size measuring device.
Figure 4:
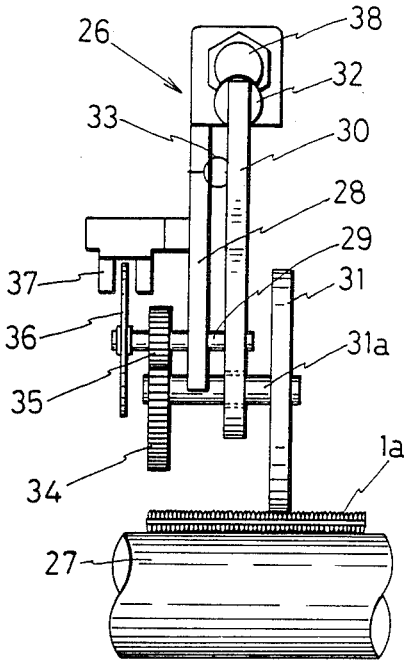
FIG. 4 is a view as looked at in the direction of an arrow IV in FIG. 3.
Figure 5:
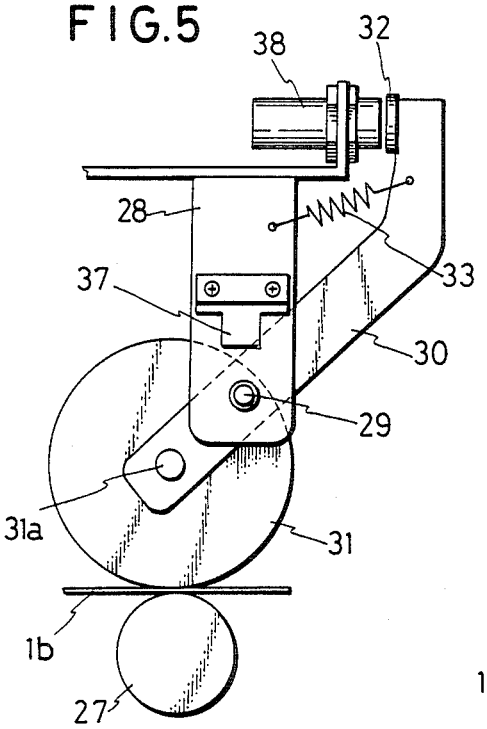
FIG. 5 is a side view with a part omitted, showing an operated state of the size measuring device.

The size measuring device 26 is provided at the inlet side for entry of the towel cloth 1 with respect to the positioning device 8. The size measuring device 26 is adapted to discriminate the kind of cloth passing by the location at which the device 26 is disposed, and to measure the extent of cloth length that has passed. The size measuring device 26 is arranged as shown in FIGS. 3 to 5. Specifically, a receiving roller 27 is rotatably mounted beneath the conveyor path 2. Above the conveyor path 2, a support bracket 28 is secured to the aforementioned support member 12. A support shaft 29 is rotatably mounted to the support bracket 28. A swing lever 30 is also pivoted to the support bracket 28 using the support shaft 29. It is to be noted that the lever 30 is fitted on the support shaft 29 to allow relative rotation therebetween and, hence, will not prevent free rotation of the support shaft 29. Attached to the lower end of the swing lever 30 is a rotatable roller shaft 31*a* of a length measuring roller 31. The swing lever 30 is normally urged by a coil spring 33 in the counterclockwise direction in FIG. 3. The length measuring roller 31 is formed to exhibit a large friction force between same and the long towel cloth 1, so that it may be rotated precisely following the movement of the long towel cloth 1. As an example, the roller 31 has formed on the outer circumference thereof a number of serrations. The spacing W between the shaft 31*a* of the length measuring roller 31 and the stopper part 17*a* is set equal to approximately 150 mm, for example. Strictly speaking, because the shaft 31*a* is provided on the lever 30, the spacing W is varied depending on whether the roller 31 lies on the piled fabric section 1*a* as shown in FIG. 3 or it lies on the flat fabric section 1*b* as shown in FIG. 5. However, such variations are very small and, hence, will not influence the operation of the towel cutting apparatus. A gear 34 fixed to the roller shaft 31*a* is meshed with another gear 35 fixed to the support shaft 29. In a detection disc 36 fixed to the support shaft 29, there are formed a number of detection parts (e.g., slits) 36*a* with equal intervals therebetween. A photosensor 37 attached to the bracket 28 is provided adjacent the disc 36. The photosensor 37 is adapted to detect passage of the detection parts 36*a* and deliver a pulse signal therefrom. Also attached to the bracket 28 is a sensor 38 for detecting whether the length measuring roller 31 lies on the piled fabric section 1a as shown in FIG. 3 or it lies on the flat fabric section 1b as shown in FIG. 5. The sensor 38 is constituted by a proximity sensor. The sensor 38 is operated so as to output an OFF signal when a detection objective, e.g., a metal piece 32, attached to the upper end of the lever 30 is far apart from the sensor 38 as shown in FIG. 3, and an ON signal when it is close to the sensor 38 as shown in FIG. 5, respectively. As the proximity sensor 38, there can be utilized any types of sensors such as the type of sensing changes in the electrostatic capacity, or the type of sensing changes in the magnetic characteristics. In the foregoing size measuring apparatus, those components indicated by reference numerals 31, 30, 32, 38 constitute means for discriminating the kind of cloth, while those components indicated by reference numerals 31, 34, 35, 36, 37 constitute means for measuring the extent of cloth length that has passed.

The adjusting device 23 is constituted by a cylinder disposed beneath the conveyor path 2, as shown in FIGS. 1 and 2. The cylinder 23 comprises a cylinder body 23*a*, and a pair of piston rods 23*b*, 24 projecting one end and the other end of the body 23*a*, respectively. The piston rod 23*b* is coupled to the support member 12 by a connection plate 25, while the piston rod 24 is coupled to the frame 3. Additionally, the adjusting device may alternatively be arranged such that a screw shaft capable of rotating forwardly and backwardly by a pulse motor, for example, is mounted to the frame 3 and a nut is fixed to the support member 12, with the nut meshing with the the screw shaft. Any of other variously well known carriage devices may also be utilized.

As shown in FIG. 2, a setting device 69 is provided adjacent the cutting device 4. The setting device 69 is adapted to fix the towel cloth, when cutting the towel cloth by the cutting device 4. The setting device 69 is composed of a receiving frame 70 fixed to the frame 3, and a setting member 72 movable up and down by a setting cylinder 71 mounted to the frame 3, for holding the long towel cloth 1 therebetween.

Figure 18:
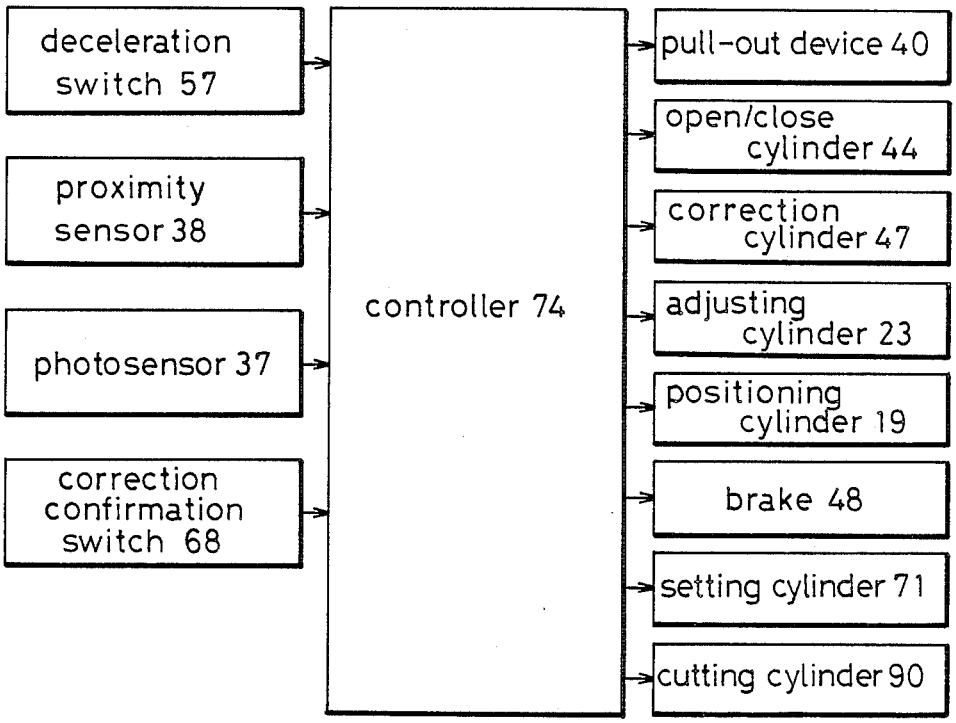
FIG. 18 is a block diagram showing the relationship between a controller and respective elements.

The above-mentioned devices are, as shown in FIG. 18, connected to a controller 74 such as a computer by way of example and controlled in their operations with command signals delivered from the controller 74 following the prescribed interrelationship therebetween as described later.

Operation of the towel cutting apparatus will be described below. When starting to cut the long towel cloth 1 at the center of the flat fabric section 1*b*, the leading edge of the long towel cloth 1 is first drawn out from a supply roll, not shown, to pass the nip between the rollers 27 and 31 of the size measuring device 26, and further to pass through the window 13 of the support member 12, as well as the gap between the pair of positioners 15 and 17 in the positioning device 8, until it finally reaches the position of the cutting blade assembly 5, as a preparatory stage. At this time, the drawn-out leading edge of the towel cloth 1 is usually given by the flat fabric section 1*b*. If otherwise, it must be so rearranged that the flat fabric section 1*b* is the leading edge of the towel cloth to be drawn out. In this preparatory stage, the respective elements of the towel cutting apparatus are in a state as shown in FIG. 2.

Figure 16:
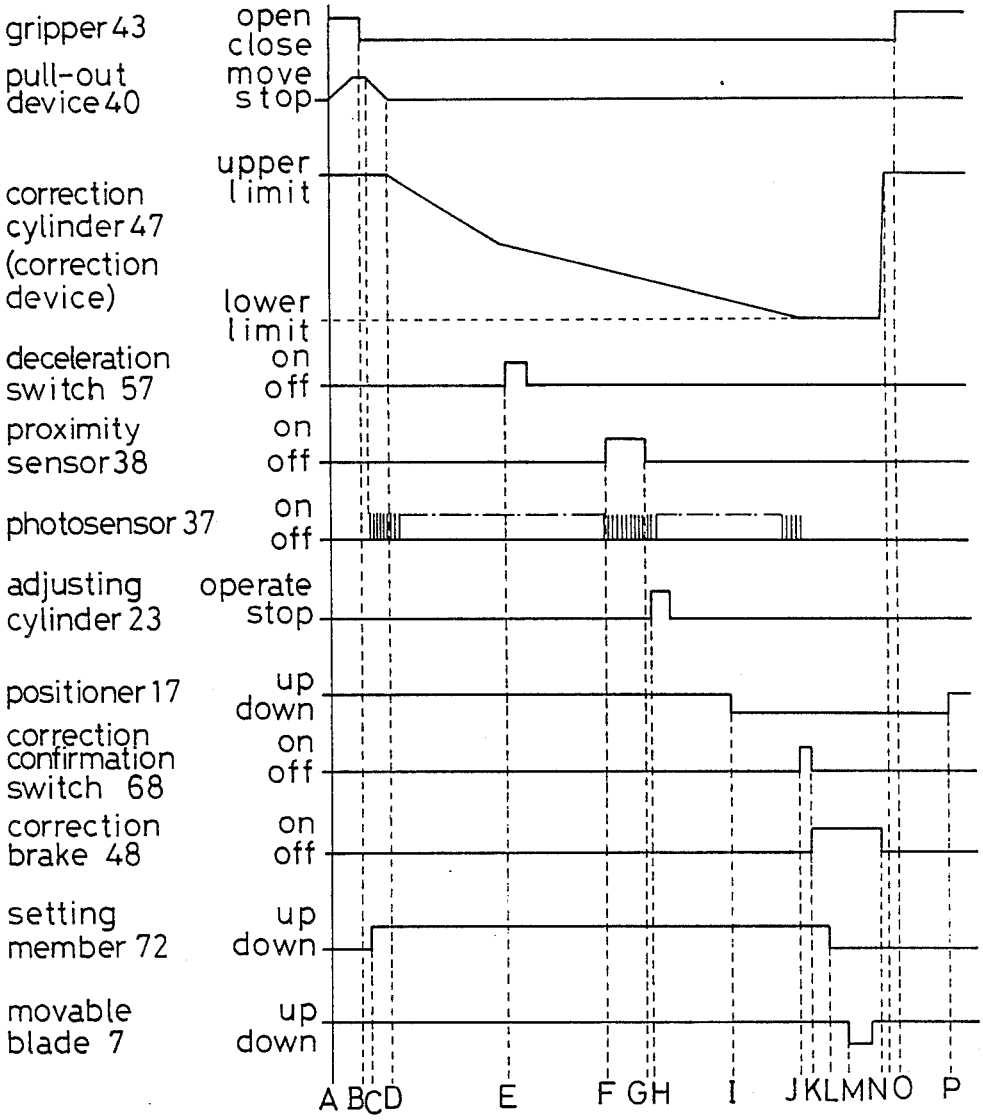
FIG. 16 is a time chart.

After starting up the towel cutting apparatus, it operates in accordance with a time chart of FIG. 16. First, at the starting point of time (point A), the setting member 72 is lowered to hold the long towel cloth 1 between same and the receiving frame 70. The gripper 43 is opening. The pull-out device 40 is moved from the state indicated by solid lines rightwardly in FIG. 2 and then stopped at the gripping position while receiving the leading edge of the long towel cloth 1 in the gripper 43. Thereafter, at point B, the gripper 43 is closed to grip the leading edge of the long towel cloth 1. At the subsequent point C, the setting member 72 is raised up to release the long towel cloth 1 from its held state. Upon release of the long towel cloth 1, the pull-out device is moved leftwardly, returning to a pull-out position. As a result, the long towel cloth 1 is pulled out by the gripper 43. Thereafter, at point D, the correction mechanism 58 starts to descent with the cylinder 47 being extended. The descent of the correction mechanism 58 causes the pushers 65 to push down the long towel cloth 1, as shown in FIG. 11 and also in FIG. 2 by chain lines. This in turn causes the long towel cloth 1 lying through the locations of the positioning device 8 and the cutting device 4 over the frame 3 to be moved leftwardly. Thereafter, at point E, the dog 56 turns on the deceleration switch 57, whereupon the descending speed of the piston rod 47*b* is reduced and the moving speed of the long towel cloth 1 to the left is also correspondingly reduced.

In the process of such leftward movement of the long towel cloth 1, the length measuring roller 31 is rotated corresponding to the movement of the cloth 1. As a result, the photosensor 37 detects the detection parts 36*a* to deliver sucessive pulse signals. At point F during the above process, the long towel cloth 1 just under the length measuring roller 31 is changed from the piled fabric section 1*a* to the flat fabric section 1*b*. This brings the length measuring roller 31 into a state of FIG. 5 where the detection objective 32 approaches the proximity sensor 38, so the sensor 38 outputs an ON signal. Thereafter, at point G, the long towel cloth 1 just under the length measuring roller 31 is now changed from the flat fabric section 1*b* to the subsequent piled fabric section 1*a*. This again spaces the detection objective 32 away from the proximity sensor 38, so that the sensor 38 outputs an OFF signal.

During the period from point F to point G in which the sensor 38 is delivering an ON signal, the controller 74 counts the pulse signals issued from the photosensor 37. Based on the counted value, it computes the length of the flat fabric section 1*b* that has passed. After such computation, at point H, the controller 24 actuates the adjusting cylinder 23 so that the spacing between the cutter 5 and the stopper part 17*a* is adjusted to be equal to approximately a half of the length of the flat fabric section 1*b* determined through the above computation.

Figure 6:
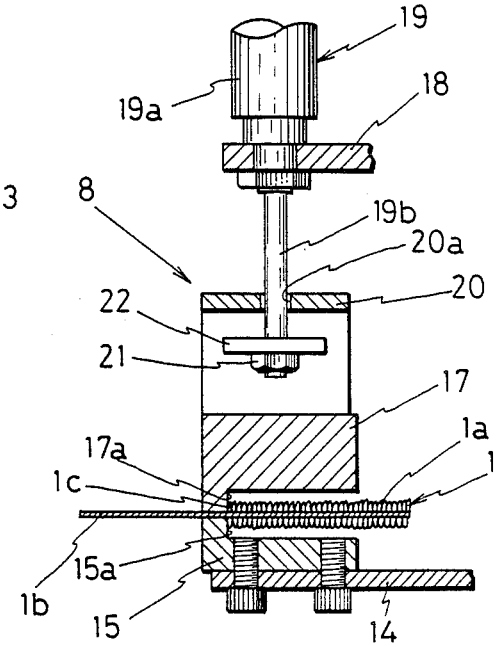
FIG. 6 is a sectional view showing an operated state of positioners.
Figure 7:
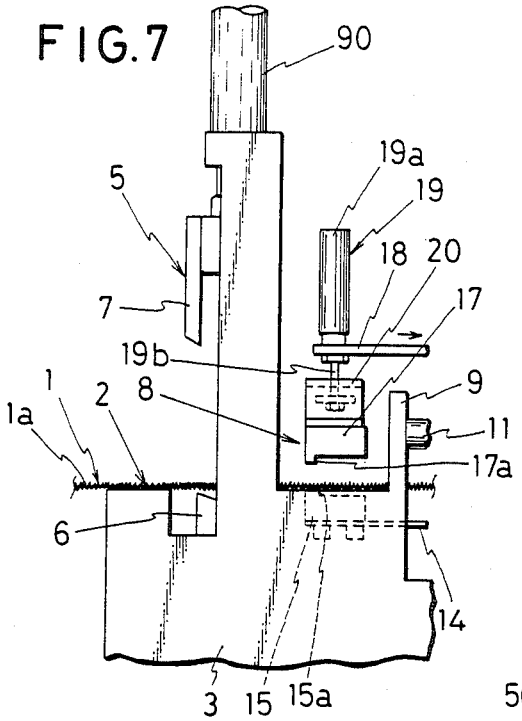
FIG. 7 is a side view showing a relatively moving state of a positioning device and a cutting device.
Figure 10:
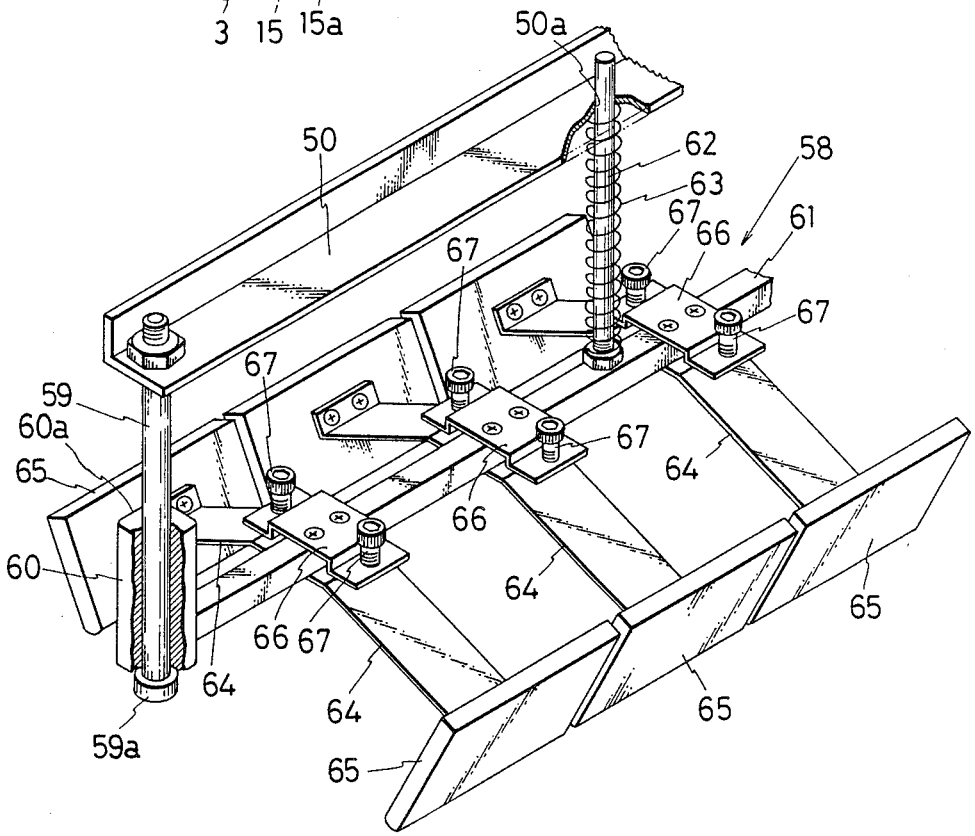
FIG. 10 is a perspective view of the correction device.
Figure 8:
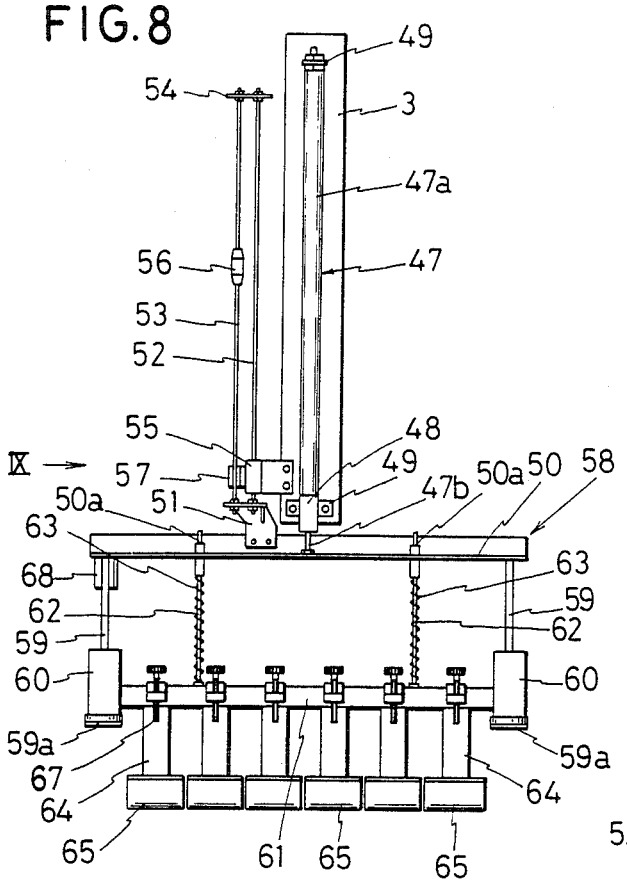
FIG. 8 is a front view of a correction device.
Figure 13:
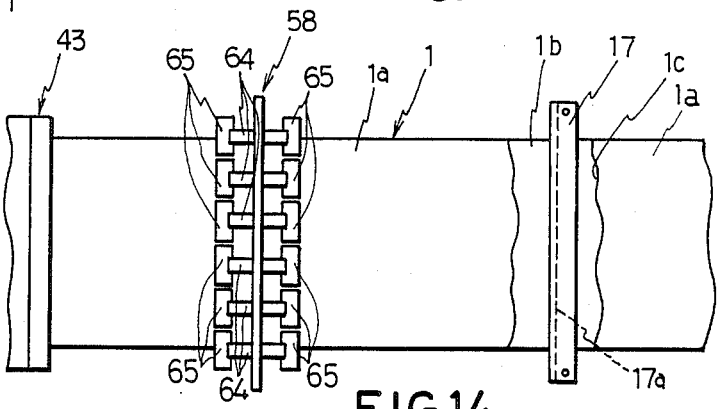
FIG. 13 is a plan view showing long towel cloth before correction.
Figure 14:
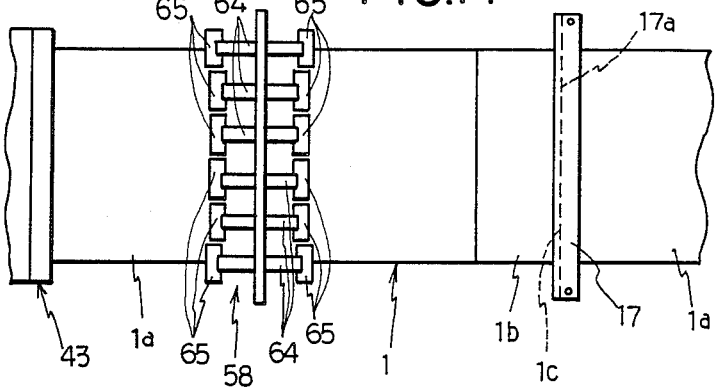
FIG. 14 is a plan view showing long towel cloth after correction.
Figure 15:
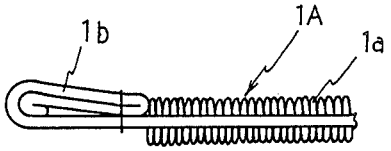
FIG. 15 is an explanatory view showing the end of a towel in the finished state.
Figure 17:
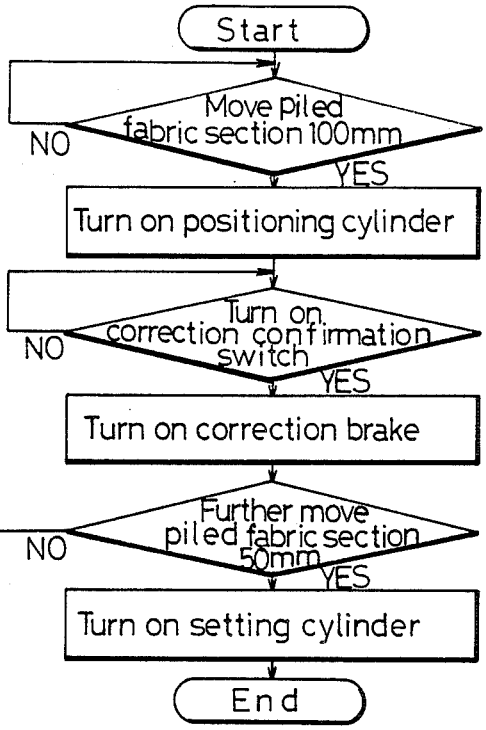
FIG. 17 is a flow chart.

After point G, the controller 74 also starts to control operation of the respective elements in accordance with a flow chart of the positioning program as shown in FIG. 17. First, after the flat fabric section 1*b* has passed by the position of the length measuring roller 31 (i.e., after point G), the controller 74 confirms based on the counted value of the pulse signals that the piled fabric section 1*a* has moved by a distance of approximately 100 mm, for example, while passing by the position of the length measuring roller 31. At such the confirmation point I, the controller 74 actuates the cylinder 19 causing the upper positioner 17 to be lowered, as shown in FIG. 6. In this case, because the spacing W between the stopper parts 15*a*, 17*a* and the length measuring roller 31 is set equal to approximately 150 mm and the succeeding piled fabric section 1a of the long towel cloth 1 has moved by a distance of approximately 100 mm at its leading end away from the position of the length measuring roller 31 with the flat fabric section 1*b* having a length of approximately 70 mm, there is no chance that either the preceding or succeeding piled fabric section 1*a* still remains or reaches between the stopper parts 15*a* and 17*a*. During this step, the support frame 50 of the correction device 46 continues to descend so that the towel cloth 1 is continually moved leftwardly. During the thus-continued process, the leading end of the piled fabric section 1*a* eventually abuts against the stopper parts 15*a*, 17*a*, as shown in FIG. 6. After this abutment, the towel cloth 1 is no longer moved even with the support frame 50 continuing to descend. As a result, upon the further descent of the support frame 50, the leaf springs 64 are elastically flexed so that the pushers 65 elastically push down the towel cloth 1. At this time, because of the plural pushers 65 being arranged in the widthwise direction of the towel cloth 1, the individual pushers 65 can operate to push down the towel cloth 1 independently. Therefore, even if the boundary 1*c* in the long towel cloth 1 is deformed undulately with respect to the stopper parts 15*a*, 17*a* during the process of pulling out the towel cloth 1, as shown in FIG. 13, it can be aligned linearly while abutting with the stopper parts 15*a*, 17*a* throughout the width of the towel cloth 1, as shown in FIG. 14.

When the boundary 1*c* comes into abutment with the stopper parts 15*a*, 17*a* throughout the width as described above, the leaf springs 64 are all brought into a state where they are resiliently flexed. After that, with the support frame 50 further descending, the spring 63 is compressed to narrow the spacing between the support frame 50 and the movable frame 61. As a result, at point J, the dog 60*a* actuates the correction confirmation switch 68. When the correction confirmation switch 68 is actuated to deliver an operation signal, the controller 74 operates the correction brake 48 to thereby lock the piston rod 47*b* at point K. Consequently, the towel cloth 1 is prevented from slacking.

When the switch 68 is actuated in this manner, the controller 74 also confirms based on the pulse signals from the photosensor 37 that the leading end of the piled fabric section 1*a* of the long towel cloth 1 has further moved by a distance of approximately 50 mm away from the position of the length measuring roller 31 after the previous leftward movement of 100 mm. In other words, it confirms that the towel cloth 1 has moved by such a distance so as to allow the boundary 1*c* to reach the stopper parts 15*a*, 17*a*. Upon this conformation, the controller 74 operates the setting cylinder 71 at the point L at which a short period of time, e.g., 0.5 sec, has elapsed after the operation of the correction brake 48. As a result, the setting member 72 is lowered to hold the flat fabric section 1*b* between same and the receiving frame 70 immobile. In the event that the above confirmation for the movement of 50 mm has not been made at the point of actuation of the switch 68, an error indication is issued and the operation of the cutting apparatus is shut down, because the boundary 1*c* is judged to be not in abutment with the stopper parts 15*a*, 17*a* (i.e., it does not reach or has passed by those parts).

In this embodiment, whether the boundary 1*c* has abutted with the stopper parts 15*a*, 17*a* or not is confirmed by making both confirmation of the operation of the switch 68 and confirmation of the movement of 50 mm. Thus, double-check is made. Accordingly, there results in very high accuracy of the confirmation for the fact that the towel cloth 1 is duly positioned in the state of FIG. 14. This is beneficial in preventing problems such as when cutting the towel cloth as described below after positioning the same, the towel cloth would be cut in the state of FIG. 13 and rejected as defective goods.

After the above confirmation, at point M, the movable blade 7 is temporarily lowered to cut the flat fabric section 1*b*. At this time, since the spacing between the cutter 5 and the stopper parts 15*a*, 17*a* is adjusted to be equal to a half of the length of the flat fabric section 1*b*, the cutter 5 cuts the flat fabric section 1*b* correctly at the center of its length. Thereafter, at point N, the operation of the correction brake 48 is released to raise up the piston rod 47*b*, so that the correction mechanism 58 is returned to the position as shown in FIG. 2. Thereafter, at point O, the gripper 43 is released to make the cut towel cloth, i.e., towel blank, free from a gripped state so that the towel blank falls downwardly. Thereafter, at point P, the upper positioner 17 is raised up for completing a series of operation cycles. After that, the long towel cloth 1 is successively cut substantially at the centers of lengths of the individual flat fabric sections 1*b* by repeating the above-mentioned operation cycles.

The relationship between the positioning device and the cutting device may be modified as follows. As an alternative, the positioning device is fixed to the frame and the cutting device is mounted movable with respect to the frame. The carriage device is then provided in association with the cutting device. As another alternative, the positioning device and the cutting device are both mounted movable with respect to the frame. The separate carriage devices are then provided in association with the positioning device and the cutting device, respectively.

As to the relationship between the size measuring device and the positioning device, it may be modified such that the size measuring device is fixed in its position with respect to the frame and only the positioning device is mounted movable with respect to the frame. In this case, when confirming that the boundary 1*c* has reached the location of the stopper parts, it is preferable to add or subtract the amount of movement of the positioning device relative to the size measuring device to or from the measured value of movement of the piled fabric section determined by the size measuring device, for correct confirmation.

As many apparently widely different embodiments of this invention may be made without departing from the spirit and scope thereof, it is to be understood that the invention is not limited to specific embodiments except as defined in the appended claims.

What is claimed is:

1. A method of cutting long towel cloth using a towel cutting apparatus which comprises:

(a) a pull-out device for pulling out towel cloth;

(b) a positioning device disposed along a conveyor path of the towel cloth pulled out by said pull-out device and adapted to, when the boundary of a flat fabric section and a subsequent piled fabric section of the towel cloth has arrived, stop the movement of said towel cloth while locking a leading end of the piled fabric section;

(c) a cutting device disposed along the conveyor path downstream relative to said positioning device in the direction of movement of the towel cloth and adapted to cut the towel cloth being positioned by said positioning device;

(d) a size measuring device disposed along the conveyor path upstream relative to said positioning device in the direction of movement of the towel cloth;

(e) an adjusting device adapted to, based on the measured value of said size measuring device, adjust the relative distance between said positioning device and said cutting device; and (f) a correction device disposed above the conveyor path and downstream relative to said cutting device in the direction of movement of said towel cloth, said positioning device comprising a pair of positioners disposed beneath and above said conveyor path of said towel cloth, respectively, for locking the leading end of the piled fabric section, each of said positioners having a width size larger than that of said towel cloth;

said size measuring device comprising means of discriminating the kind of cloth and means of measuring the length of cloth that has passed; and said correction device comprising a support frame capable of moving up and down across the conveyor path, a movable frame coupled to said support frame to be movable up and down with respect thereto, a spring interposed between said support frame and said movable frame for normally urging said movable frame apart away from said support frame, a switch actuated to deliver an operation signal when said support frame and said movable frame are moved to approach against a resilient force of said urging spring, and a plurality of leaf springs arranged in the widthwise direction of the towel cloth, each of said leaf springs having the upper end attached to said movable frame and the lower end to which a pusher is attached, said cutting method comprising the steps of:

pulling out the towel cloth by said pull-out device;

lowering said support frame of said correction device across the conveyor path of said towel cloth, causing said pushers to push down the towel cloth lying between said pull-out device and said positioning device to thereby further pull out said towel cloth;

measuring the length size of the flat fabric section of the pulled-out towel cloth by said size measuring device, during the process in which the towel cloth is additionally pulled out by said correction device;

adjusting the relative distance between said positioning device and said cutting device by said adjusting device based on the measured length of the flat fabric section, so that the spacing between said positioning device and said cutting device becomes equal to a half of said measured length, positioning the cutting device to sever said flat fabric sections along a line midway between piled fabric sections;

stopping the movement of said towel cloth with said positioners of said positioning device locking the boundary between the flat fabric section and the piled fabric section of the towel cloth, during the process in which the towel cloth is additionally pulled out by said correction device;

confirming the operation of said switch in said correction device;

confirming by said size measuring device that, after the boundary between the flat fabric section and the piled fabric section of the towel cloth past the location of said size measuring device, the towel cloth has moved by such a distance as allowing said boundary to reach the location of said positioners; and cutting said towel cloth by said cutting device after said two types of confirmation, whereby said towel cloth is secured in said flat section midway between ends of said piled fabric sections.

2. In a towel cloth cutting apparatus comprising:

(a) a pull-out device for pulling out towel cloth;

(b) a positioning device disposed along a conveyor path of the towel cloth pulled out by said pull-out device and adapted to, when the boundary of a flat fabric section and a subsequent piled fabric section of the towel cloth has arrived, stop the movement of the towel cloth while locking a leading end of the piled fabric section; and (c) a cutting device disposed along the conveyor path downstream relative to said positioning device in the direction of movement of the towel cloth and adapted to cut the towel cloth being positioned by said positioning device, the improvement further including:

(d) a size measuring device disposed along the conveyor path upstream relative to said positioning device in the direction of movement of the towel cloth and designed to measure the length of the flat fabric section of the towel cloth; and (e) an adjusting device which, based on the measured value of length of the flat fabric section determined by said size measuring device, adjusts the relative distance between said positioning device and said cutting device so that the spacing between said positioning device and said cutting device becomes equal to a half of said measured value, whereby said towel cloth is always cut on said flat fabric section along a line midway between piled fabric sections.

3. A towel cloth cutting apparatus according to claim 2, further including a correction device disposed above the conveyor path and downstream relative to said cutting device in the direction of movement of the towel cloth;

said correction device comprising a movable frame capable of moving up and down across the conveyor path, and a plurality of leaf springs arranged in the widthwise direction of the towel cloth, each of said leaf springs having the upper end attached to said movable frame and the lower end to which a pusher is attached; and said positioning device comprising a pair of positioners disposed beneath and above the conveyor path of the towel cloth, respectively, for locking the leading end of the piled fabric section, each of said positioners having a width size larger than that of the towel cloth width.

* * * * *